US007806154B2

(12) United States Patent
Yang

(10) Patent No.: US 7,806,154 B2
(45) Date of Patent: Oct. 5, 2010

(54) SHAPER GUARD

(76) Inventor: Jack Yang, No. 176, Yuanhuan S. Rd., Fongyuan City, Taichung County (TW)

( * ) Notice: Subject to any disclaimer, the term of this patent is extended or adjusted under 35 U.S.C. 154(b) by 204 days.

(21) Appl. No.: 12/116,261

(22) Filed: May 7, 2008

(65) Prior Publication Data

US 2008/0202634 A1 Aug. 28, 2008

Related U.S. Application Data

(63) Continuation-in-part of application No. 11/415,178, filed on May 2, 2006, now abandoned.

(51) Int. Cl.
*B27G 19/00* (2006.01)

(52) U.S. Cl. ..... 144/251.1; 83/440.2; 409/134

(58) Field of Classification Search ..... 144/251.1, 144/251.2, 2, 251.3, 252.2; 83/105, 440.2; 409/134, 175; 408/241 R, 241 G
See application file for complete search history.

(56) References Cited

U.S. PATENT DOCUMENTS 3,105,530 A * 10/1963 Peterson ..... 83/478
4,062,391 A * 12/1977 Piazzola ..... 144/251.2
4,126,081 A * 11/1978 Zdeb ..... 409/134
4,842,031 A 6/1989 Peek ..... 144/251.2
4,884,927 A 12/1989 Menker ..... 409/134
5,117,880 A 6/1992 Kapton et al. ..... 144/251.1
5,231,906 A * 8/1993 Kogej ..... 83/478
D341,600 S 11/1993 Wixey et al. ..... D15/131
D374,239 S 10/1996 Chen ..... D15/130

* cited by examiner

*Primary Examiner*—Shelley Self
(74) *Attorney, Agent, or Firm*—Alan Kamrath; Kamrath & Associates PA

(57) ABSTRACT

A shaper guard includes a fixture assembly having a sleeve adapted to be statically fixed on a shaper and a rotating member pivotally connected with the sleeve. A first guard panel has a connecting portion connected with the sleeve. A second guard panel has a connecting portion connected with the rotating member and is pivotable in concert with the rotating member with respect to the sleeve and the first guard panel. The second guard panel is biasable by the workpiece fabricated on the shaper. The shaper guard has a simple structure.

9 Claims, 8 Drawing Sheets

SHAPER GUARD

CROSS REFERENCE

The present application is a continuation-in-part application of U.S. patent application Ser. No. 11/415,178, filed on May 2, 2006, now abandoned, of which the entire disclosure is incorporated herein.

BACKGROUND OF THE INVENTION

1. Field of the Invention

The present invention relates to a shaper guard and, in particular, to a shaper guard that has a guard panel biased by the workpiece fabricated on the shaper and that has a simple structure.

2. Description of the Related Art

FIG. 1 shows a safeguard 1 for a known shaper 2. The safeguard 1 is formed of a panel. A bracket 3 used for connecting the safeguard 1 is connected to the shaper 2. The bracket 3 includes a rod 4 extended therefrom for receiving a fixing block 5 that is used to hold the safeguard 1 in place. Further, the safeguard 1 is positioned at the front of the shaper 2 so as to provide protection for an operator standing at the front of the shaper 2.

While the safeguard 1 is adapted to preclude dust and chippings produced by a workpiece fabricated on the shaper 2 from hurting the operator standing at the front of the shaper 2, this safeguard 1 is not adapted to provide an absolute protection to the operator. As a matter of fact, the safeguard 1 can not protect these byproducts of the workpiece from shooting upward from the shaper 2.

U.S. Pat. No. 5,117,880 to Kapton discloses a protective shield including a horizontal shield plate 310 and a vertical shield plate 320. However, the first and second shield plates 310 and 320 are configured with complexities. The horizontal shield 310 is pivotable with a connector pin 314, and the vertical shield 320 is pivotable with a pin 318extended from the horizontal shield 310. Further, the vertical shield 320 includes a slot 329 moveably receiving a projection 319 of the horizontal shield 310.

Also, U.S. Pat. No. 4,842,031 discloses a guard with an arcuate periphery. However, the guard is pivotally connected with two pins.

The present invention is, therefore, intended to obviate or at least alleviate the problems encountered in the prior art. Additionally, the present invention is intended to provide a safeguard that is adapted to be biased by the workpiece fabricated on the shaper more easily and effectively.

SUMMARY OF THE INVENTION

A shaper guard in accordance with the present invention includes a fixture assembly having a sleeve adapted to be statically fixed on a shaper and a rotating member pivotally connected with the sleeve. A first guard panel has a connecting portion connected with the sleeve. A second guard panel has a connecting portion connected with the rotating member and is pivotable in concert with the rotating member with respect to the sleeve and the first guard panel. The second guard panel is biasable by the workpiece fabricated on the shaper.

The shaper guard also includes an engaging member, and the rotating member includes a cutout comprising two sides cooperating to define an angle. The engaging member is selectively engagable with the sides when the rotating member is rotated.

It is an object of the present invention that the shaper guard has a simple structure.

It is another object of the present invention that the first and second guard panels are transparent, allowing the operator to easily inspect the condition of the blade on the shaper.

It is yet another object of the present invention that the guard panels have an angular range of motions corresponding to the angle defined by the sides.

It is still another object of the present invention that the rotating member is pivotable relative to the sleeve.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

BRIEF DESCRIPTION OF THE DRAWINGS

For the present disclosure to be easily understood and readily practiced, the present disclosure will now be described in conjunction with the following figures, wherein.

DETAILED DESCRIPTION OF THE PREFERRED EMBODIMENT

Figure 1:
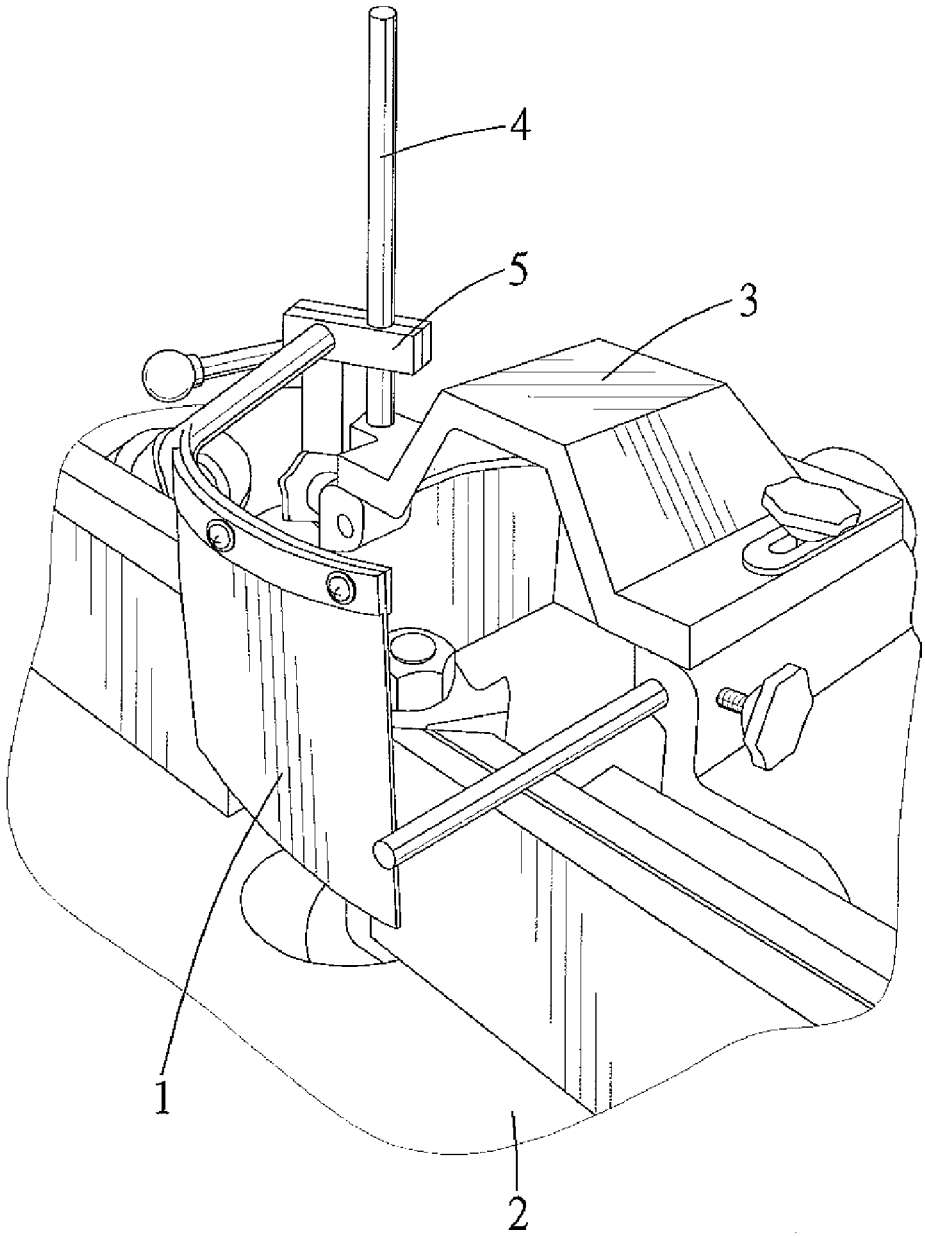
Fig. 1 PRIOR ART
FIG. 1 is a partial perspective view of a shaper with a conventional shaper guard.
Figure 2:
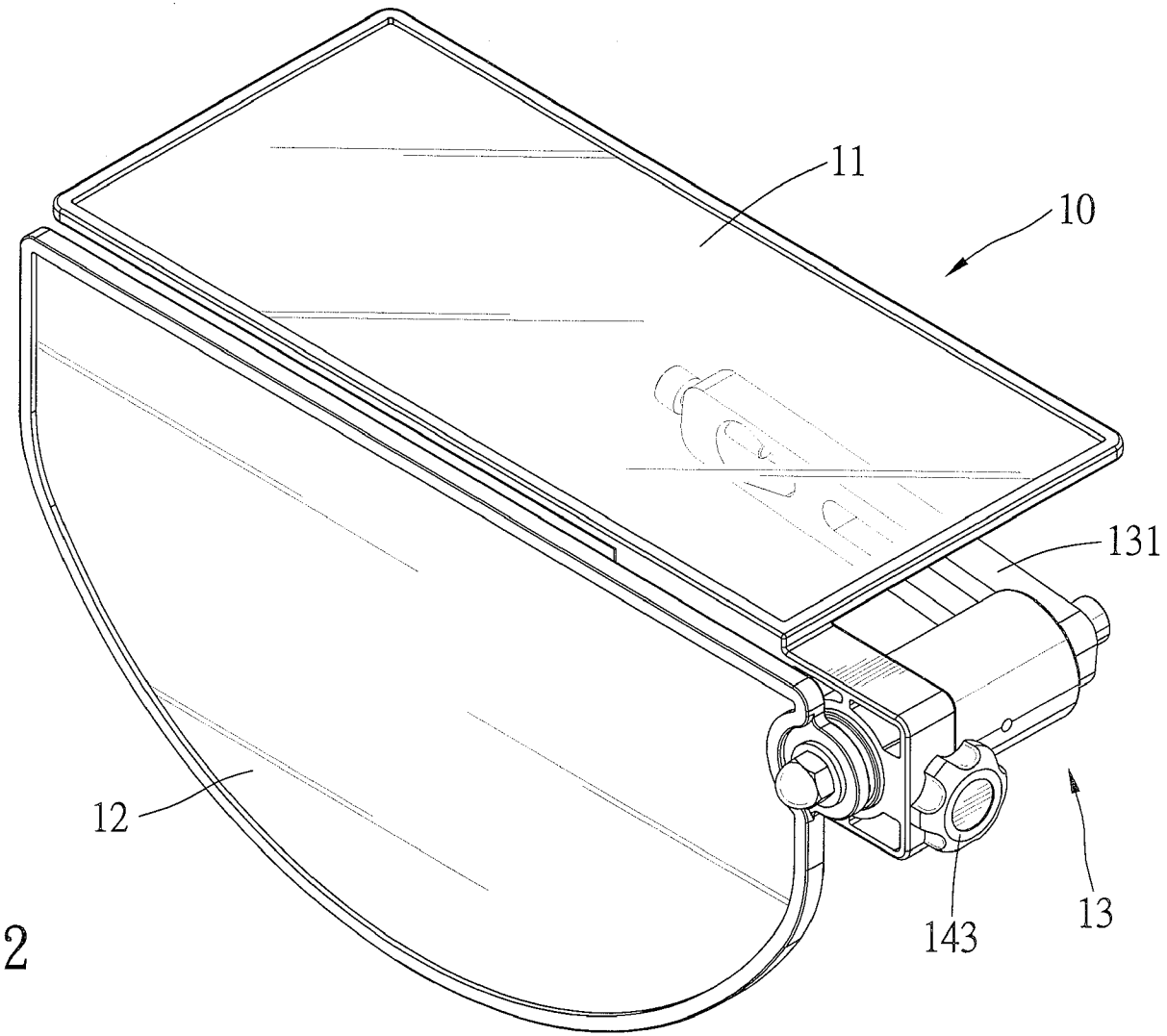
FIG. 2 is a perspective view of a shaper guard in accordance with the present invention.
Figure 3:
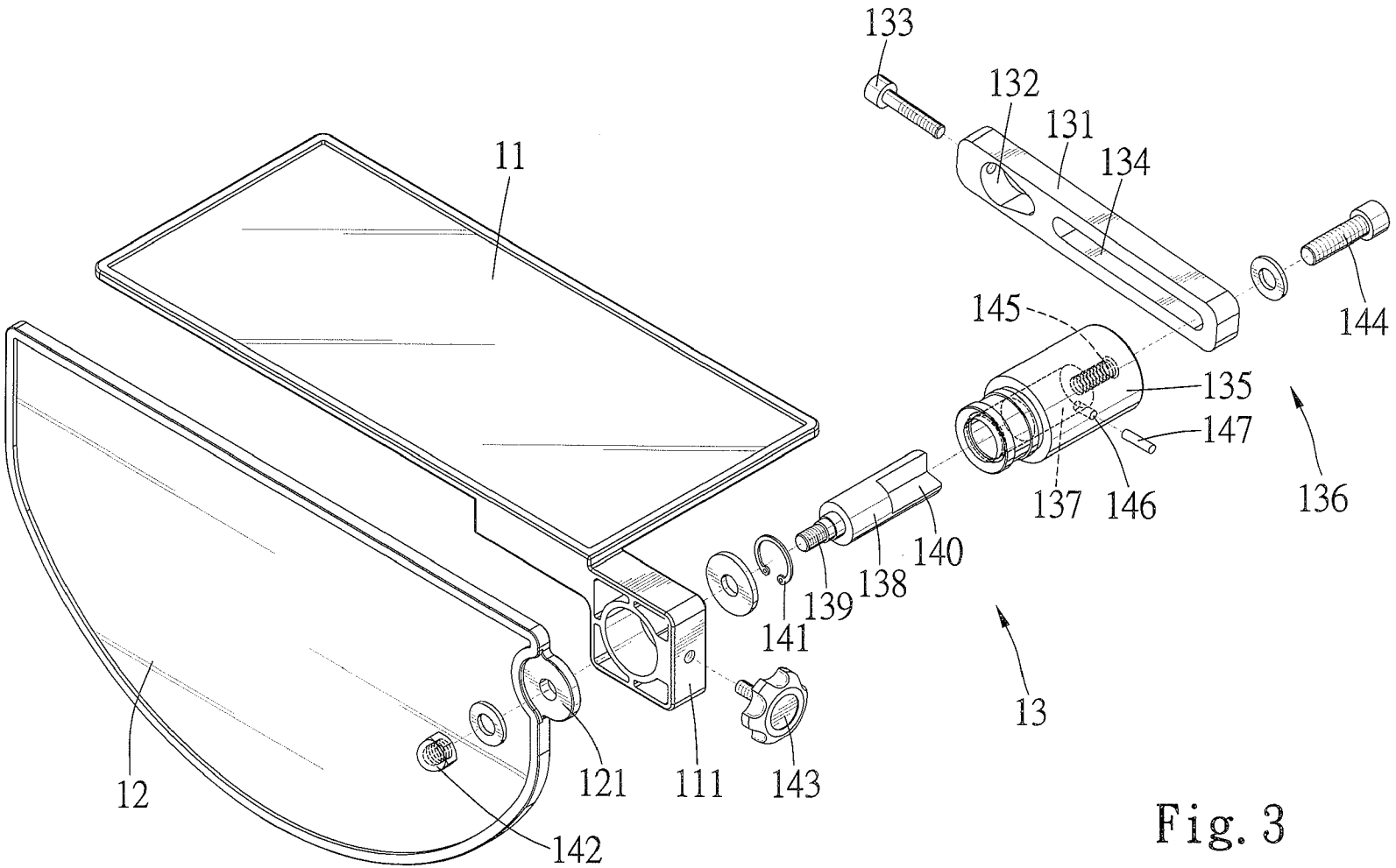
FIG. 3 is an exploded perspective view of the shaper guard of FIG. 2.

Referring to the drawings, a shaper guard 10 in accordance with the present invention includes first and second guard panels 11 and 12 and a fixture assembly 13 connecting the guard panels 11 and 12 to a work platform 20 of a shaper as well as interconnecting the guard panels 11 and 12.

Preferably, the first and second guard panels 11 and 12 are transparent for allowing the operator to easily inspect the condition of the blade on the shaper and are explosion-proof. Preferably, the second guard panel 12 has an arcuate periphery.

Figure 7:
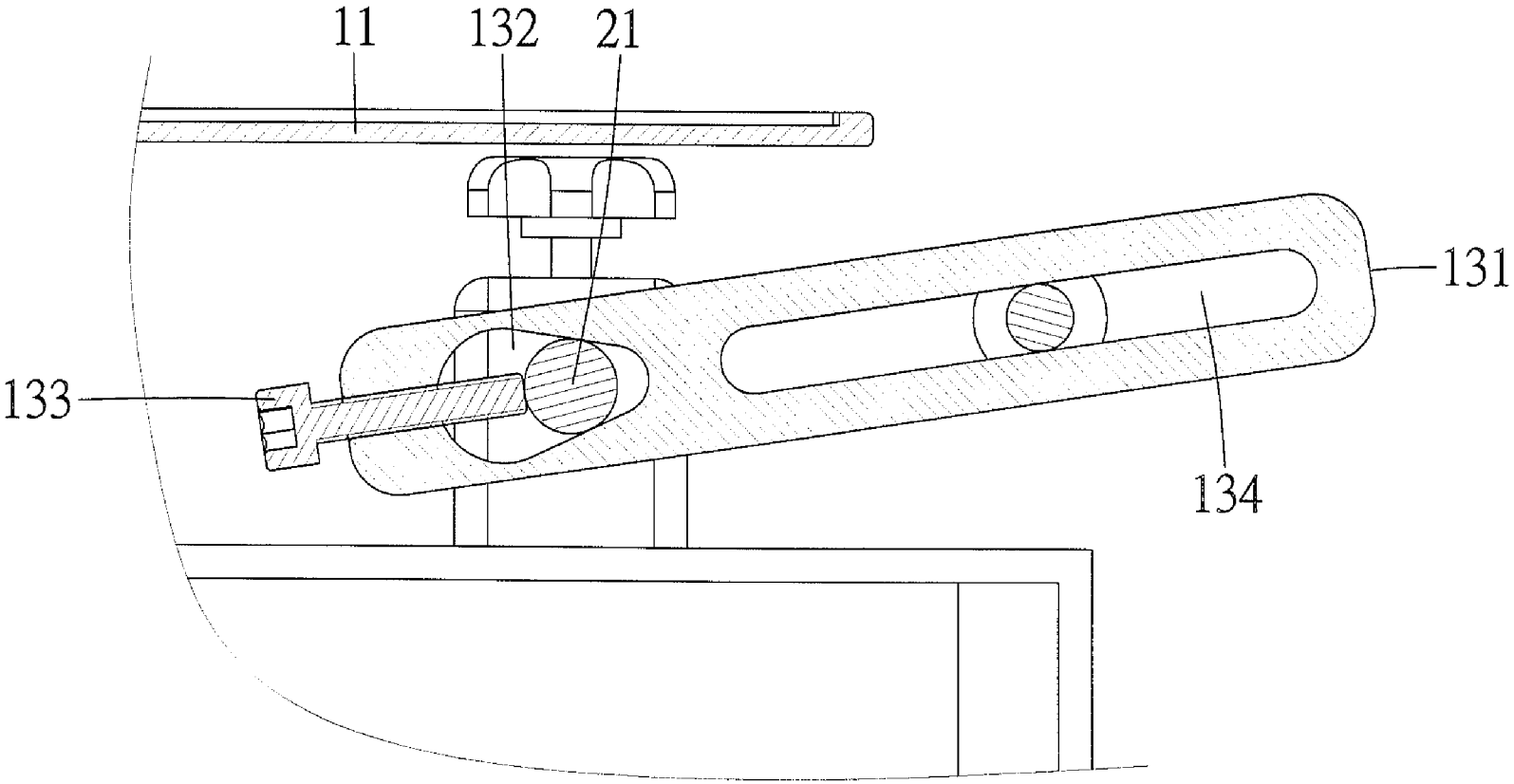
FIG. 7 is a sectional view taken along line 7-7 of FIG. 4.
Figure 8:
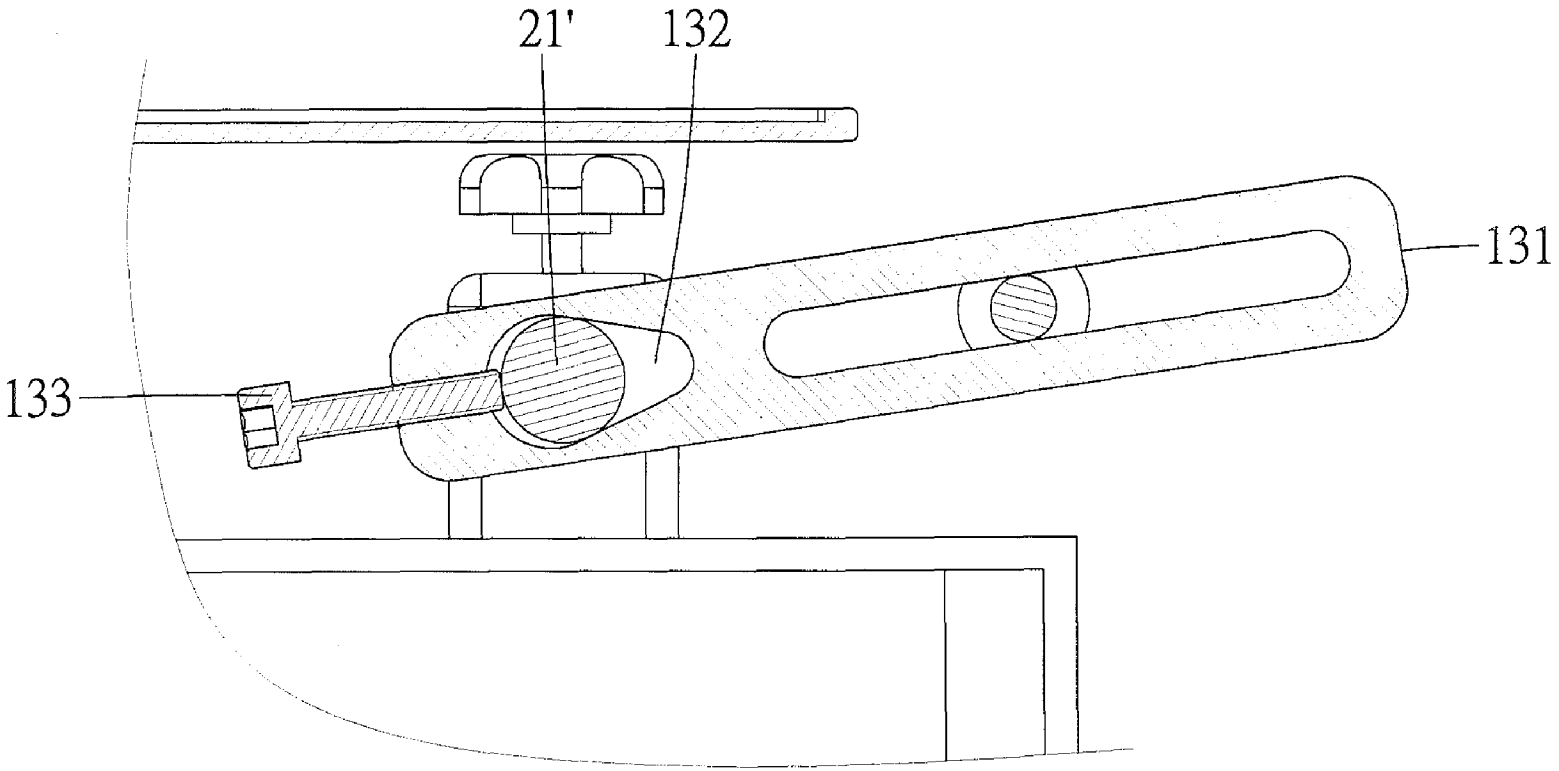
FIG. 8 is a sectional view similar to FIG. 7, but showing a through hole with a profile which gradually becomes flared from a first end to a second end and adapted to be inserted by a shaft with a larger diameter.

In this preferred embodiment, the fixture assembly 13 includes a fixture member 131 having a hole 132, and the work platform 20 has a fixing member 21 inserted through the hole 132 thereby connecting the fixture assembly 13 with the work platform 20. Further, the hole 132 has a profile which gradually becomes flared from a first end to a second end. With this configuration, the hole 132 is thus suitable for receiving at least two different dimensioned fixing members 21 and 21', as illustrated in FIGS. 7 and 8. Further, a fastener 133 may be included to engage with the fixture member 131 for securely holding the fixture member 131 in place on the fixing member 21.

The fixture assembly 13 further includes a sleeve 135 secured on the fixture member 131. Preferably, a connection means 136 or any other attaching means is utilized to secure the sleeve 135 on the fixture member 131. In this preferred embodiment, the connection means 136 includes a bolt 144 and an inner thread 145 defined in the sleeve 135. The bolt 144 is inserted through the fixture member 131, preferably through a slot 134 defined in the fixture member 131, and, then, engaged in the inner thread 145, thereby holding the sleeve 135 in place on the fixture member 131. Further, a gasket (not numbered) may be included for preventing the bolt 144 threaded on the fixture member 131 from damaging the fixture member 131. Additionally, prior to fully tightening the sleeve 135 to the fixture member 131, the bolt 144 is adapted to change its position within the slot 134. Therefore, the sleeve 135 can be fixed at various positions with respect to the fixture member 131, giving the fixture assembly 13 more adaptability to the shaper.

Also, the sleeve 135 and the first guard panel 11 are connected. In this embodiment, the first guard panel 11 has a connecting portion 111 engaged on the sleeve 135 thereby connecting the sleeve 135 with the first guard panel 11. Further, an engaging member 143 is inserted into the connection portion 111 of the first guard panel 11 and abuts against an outer periphery of the sleeve 135 that is engaged with the connection portion 111.

The fixture assembly 13 further includes a rotating member 138 axially connected with the sleeve 135 and rotatable relative to the sleeve 135. In this preferred embodiment, the sleeve 135 includes a compartment 137 defined therein, the rotating member 138 is received in the compartment 137. Further, the compartment 137 is adapted to receive a seal 141 for confining the rotating member 138 within the sleeve 135.

The rotating member 138 includes a first end defining a threaded section 139 and a second end including a cutout 140 defining two sides cooperating to form an angle. The first end of the rotating member 138 is disposed outside the compartment 137 and is connected to the second guard panel 12. In this preferred embodiment, the second guard panel 12 has a connecting portion 121 that the threaded section 139 of the rotating member 138 is inserted through thereby connecting the second guard panel 12 with the rotating member 138. Further, an end cap 142 is engaged with the threaded section 139 of the rotating member 138 so as to prevent the second guard panel 12 as well as the first guard panel 11 from disengaging from the rotating member 138 and the sleeve 135 respectively. Additionally, a gasket (not numbered) may be included between the connecting portion 121.

The fixture assembly 13 further includes a pin 147 selectively engaged with two sides of the cutout 140 of the rotating member 138. As one side of the cutout 140 is engaged with the pin 147, further rotation of the rotating member 138 is inhibited. Likewise, as another side of the side of the cutout 140 is engaged with the pin 147, further rotation of the rotating member 138 is inhibited. Accordingly, the second guard panel 12 has an angular range of motion corresponding to the angle defined by the sides. In this preferred embodiment, the pin 147 is inserted through an aperture 146 of the sleeve 135 and engaged with the cutout 140 disposed within the compartment 137 in the sleeve 135.

Figure 4:
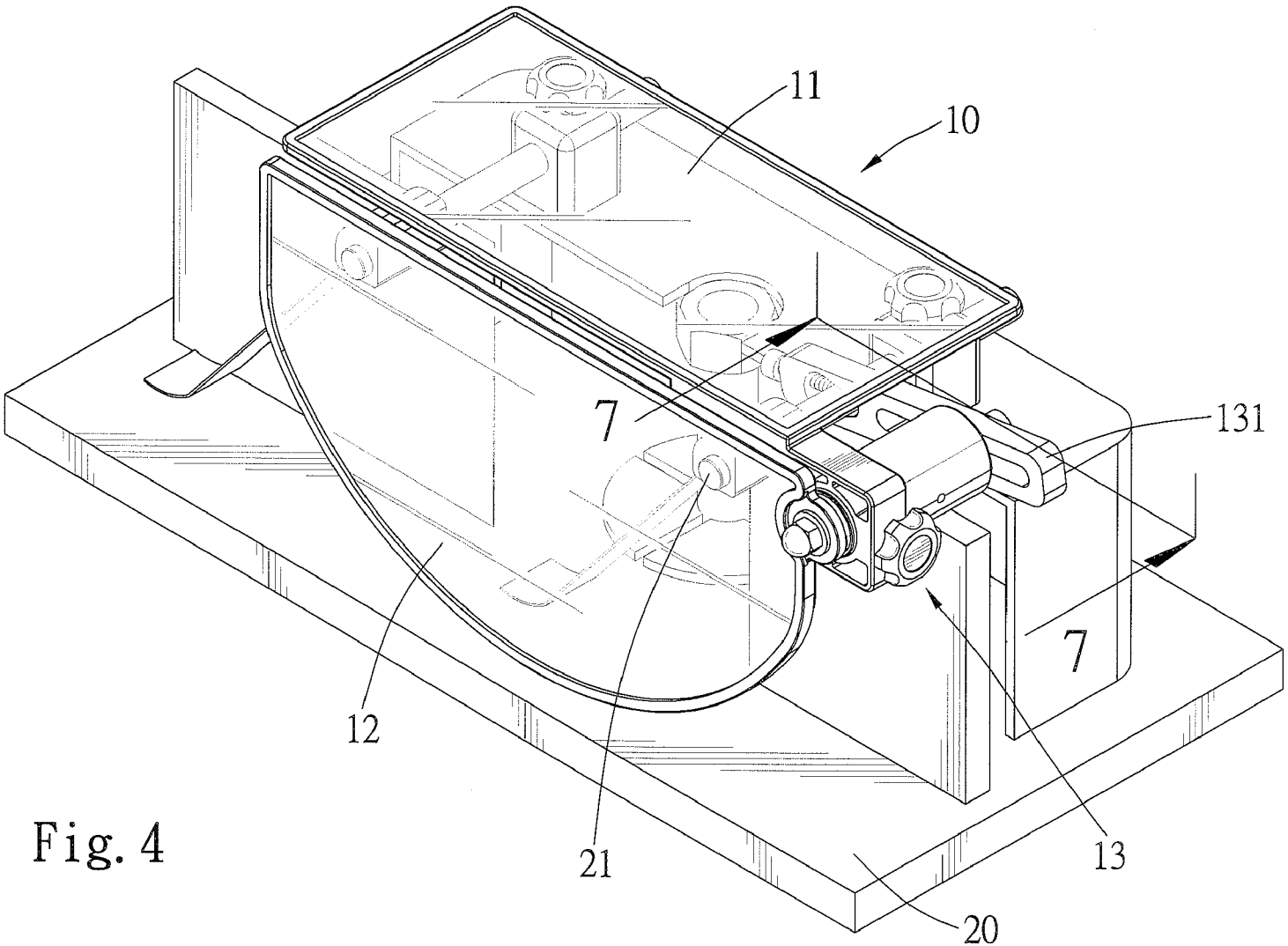
FIG. 4 is a perspective view showing the shaper guard of FIG. 2 installed on a work platform of a shaper.
Figure 5:
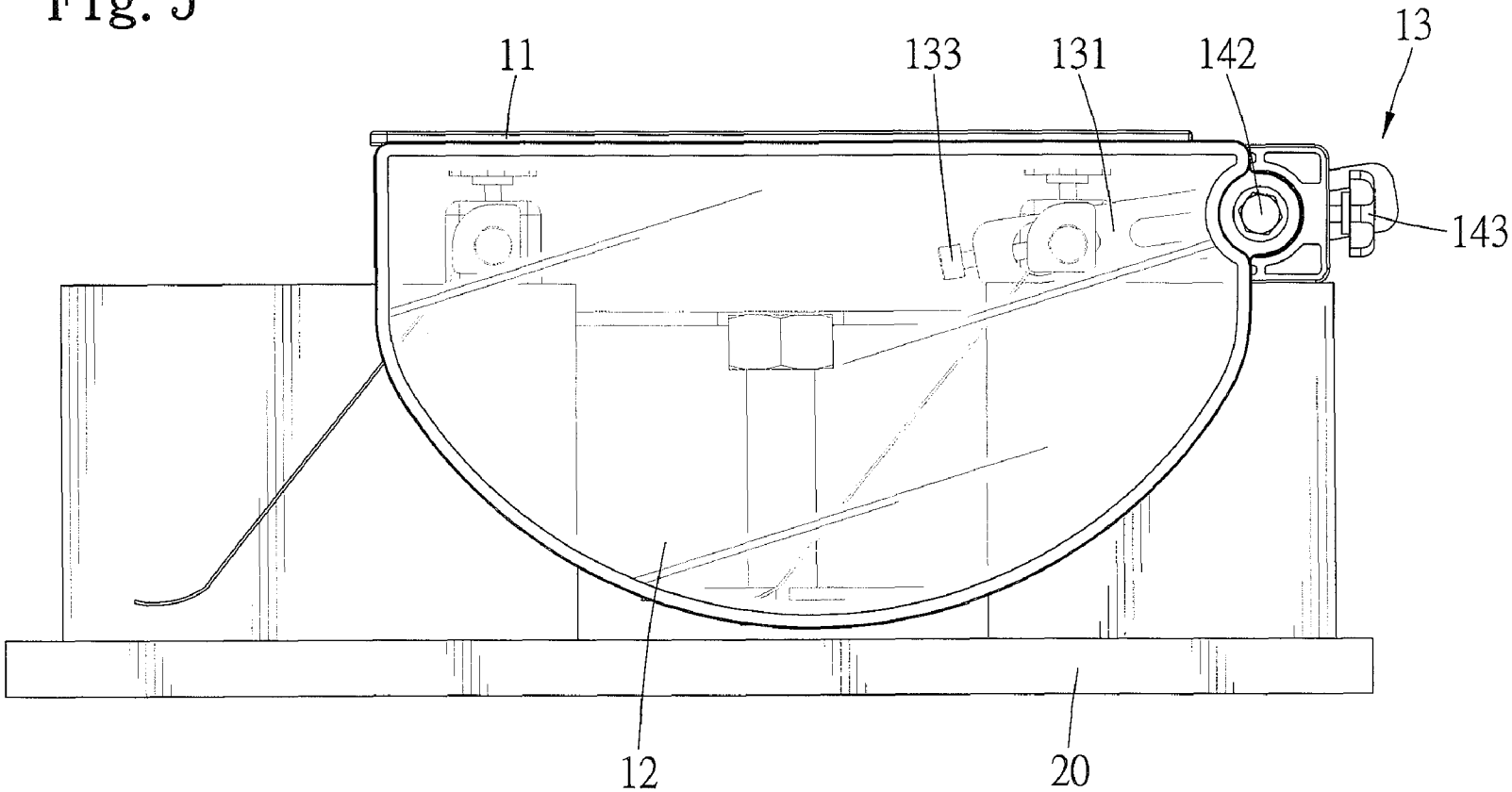
FIG. 5 is a side view of the shaper guard of FIG. 4.
Figure 6:
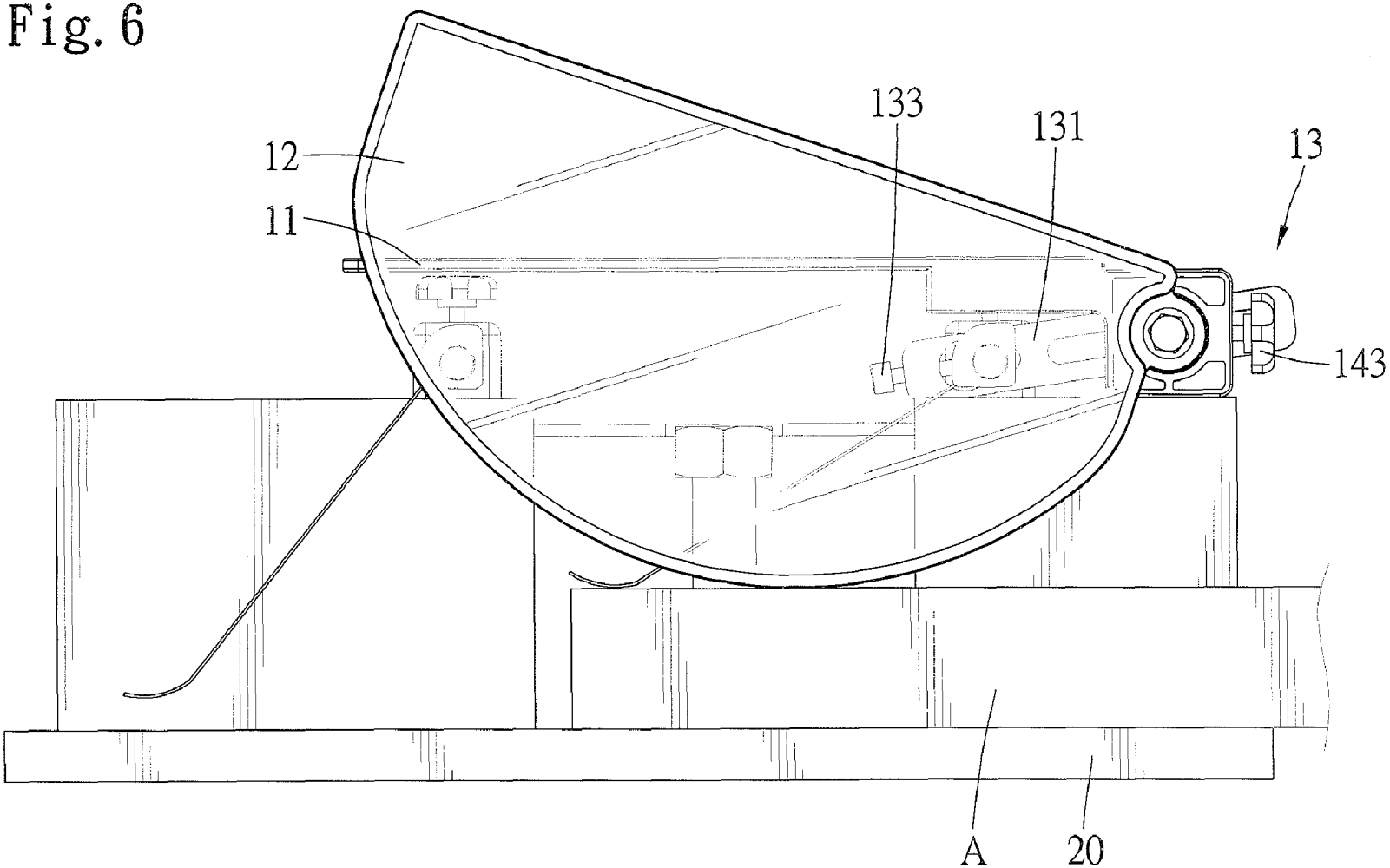
FIG. 6 is a side view similar to FIG. 5, but illustrating the engagement of the shaper guard with the workpiece.

Referring to FIGS. 4 through 6, when a shaper is installed with the shaper guard 10 of the present invention, the first guard panel 11 is substantially parallel to the work platform 20 while the second guard panel 12 is substantially perpendicular to the work platform 20. As a workpiece A is gradually moved from the far right side to the far left side of the work platform 20, the second guard panel 12 is adapted to be elevated easily by the workpiece A due to its arcuate periphery and adapted to be pivoted in concert with the rotating member 138. Additionally, the second guard panel 12 is adapted to pivot back to the position as shown in FIG. 5 after the workpiece A is not engaged with the second guard panel 12.

While the specific embodiments have been illustrated and described, numerous modifications come to mind without significantly departing from the spirit of invention and the scope of invention is only limited by the scope of accompanying claims.

What is claimed is:

1. A shaper guard comprising:

a fixture assembly including a sleeve adapted to be statically fixed on a shaper and a rotating member pivotally received within the sleeve;

a first guard panel having a connecting portion connected with the sleeve; and a second guard panel having a connecting portion connected with the rotating member and being pivotal in concert with the rotating member with respect to the sleeve;

wherein the sleeve includes a compartment defined therein, wherein the rotating member includes a cutout disposed in the compartment, wherein the sleeve comprises an aperture in communication with the compartment and a pin received in the aperture, and wherein the cutout comprises two sides cooperating to define an angle, with the pin selectively engagable with the two sides when the rotating member is rotated.

2. The shaper guard as claimed in claim 1 further comprising a seal disposed in the compartment for confining the rotating member in the compartment.

3. The shaper guard as claimed in claim 1, with the first and second guard panels being transparent.

4. A shaper guard comprising:

a fixture assembly including a sleeve adapted to be statically fixed on a shaper and a rotating member pivotally received within the sleeve;

a first guard panel having a connecting portion connected with the sleeve;

a second guard panel having a connecting portion connected with the rotating member and being pivotal in concert with the rotating member with respect to the sleeve;

a fixture member for connecting the sleeve to the shaper, with the fixture member including a hole and a slot, and with the hole having a profile which gradually becomes flared from a first end to a second end; and a connection means including a bolt and a threaded section defined in the sleeve, wherein the bolt is inserted through the slot and engaged in the threaded section whereby the sleeve is adapted to be secured on the fixture member.

5. The shaper guard as claimed in claim 4 wherein the sleeve comprises a compartment defined therein, and wherein the rotating member comprises a cutout disposed in the compartment.

6. The shaper guard as claimed in claim 5 further comprising an engaging member, and wherein the cutout comprises two sides cooperated to define an angle, and with the engaging member selectively engagable with the sides when the rotating member is rotated.

7. The shaper guard as claimed in claim 6 further comprising a seal disposed in the compartment for confining the rotating member in the compartment.

8. The shaper guard as claimed in claim 6, with the first and second guard panels being transparent.

9. The shaper guard as claimed in claim 8, with the second guard panel having an arcuate periphery.

* * * * *